US010201056B1

(12) United States Patent
Gordin et al.

(10) Patent No.: US 10,201,056 B1
(45) Date of Patent: Feb. 5, 2019

(54) VARYING COLOR OF LED LIGHT USING METAMERS

(71) Applicant: MUSCO CORPORATION, Oskaloosa, IA (US)

(72) Inventors: Myron Gordin, Oskaloosa, IA (US); Lawrence H. Boxler, Columbus, IN (US)

(73) Assignee: Musco Corporation, Oskaloosa, IA (US)

( * ) Notice: Subject to any disclaimer, the term of this patent is extended or adjusted under 35 U.S.C. 154(b) by 501 days.

(21) Appl. No.: 14/955,378

(22) Filed: Dec. 1, 2015

Related U.S. Application Data

(60) Provisional application No. 62/086,440, filed on Dec. 2, 2014.

(51) Int. Cl.
*H05B 33/08* (2006.01)

(52) U.S. Cl.
CPC ..... *H05B 33/0857* (2013.01); *H05B 33/0845* (2013.01); *H05B 33/0854* (2013.01)

(58) Field of Classification Search
CPC ..... H05B 33/0857; H05B 33/0872
See application file for complete search history.

(56) References Cited

U.S. PATENT DOCUMENTS 5,803,579 A * 9/1998 Turnbull ..... B60L 1/14 257/E25.02
6,132,072 A * 10/2000 Turnbull ..... B60L 1/14 257/E25.02
6,523,976 B1 * 2/2003 Turnbull ..... B60L 1/14 362/231
6,631,987 B2 10/2003 Reichow et al.
8,258,722 B2 9/2012 Swoboda et al.
8,319,455 B2 * 11/2012 Bennette ..... H05B 37/02 315/149
8,403,523 B2 * 3/2013 Gerlach ..... H05B 37/02 362/230

(Continued)

OTHER PUBLICATIONS

Berman, Sam M., "New Discoveries in Vision Affect Lighting Practice", Lawrence Berkeley Nat'l. Lab., Berkeley, CA, USA, http://www.robertsresearchinc.com/Papers/Berman_New_Discoveries_in_Vision_Affect_Lighting_Practice.pdf, downloaded Nov. 20, 2014. Nov. 20, 2014.

Horiguchi, Hiroshi, et al., "Human Trichromacy Revisited", Proceedings of the National Academy of Sciences, USA, Early Edition, www.pnas.org/cgi/doi/10.1073/pnas.1214240110, pp. 38-47 (Early on-line publication). Dec. 19, 2012.

(Continued)

*Primary Examiner* — William N Harris
(74) *Attorney, Agent, or Firm* — McKee, Voorhees & Sease, PLC

(57) ABSTRACT

Methods and systems for illuminating areas or objects in areas by manipulating the spectral power distributions (SPDs) of light sources. In one aspect, light of a given desired correlated color temperature (CCT), white in one example, is adjusted by a metamer to a different SPD designed to produce improved perceived brightness by observers. This retains the desired CCT but can allow for such things as reduced number of light fixtures or light sources, less energy, and/or longer effective light source lives for the same perceived brightness of conventional lightings. In another aspect, composite SPD regardless of CCT can be manipulated for other benefits such as highlighting portions of or objects in the area, or improving lighting performance for such things as weather conditions (e.g. snow or fog) or ambient conditions (e.g. twilight).

17 Claims, 13 Drawing Sheets

(56) References Cited

U.S. PATENT DOCUMENTS

Figure 1A:
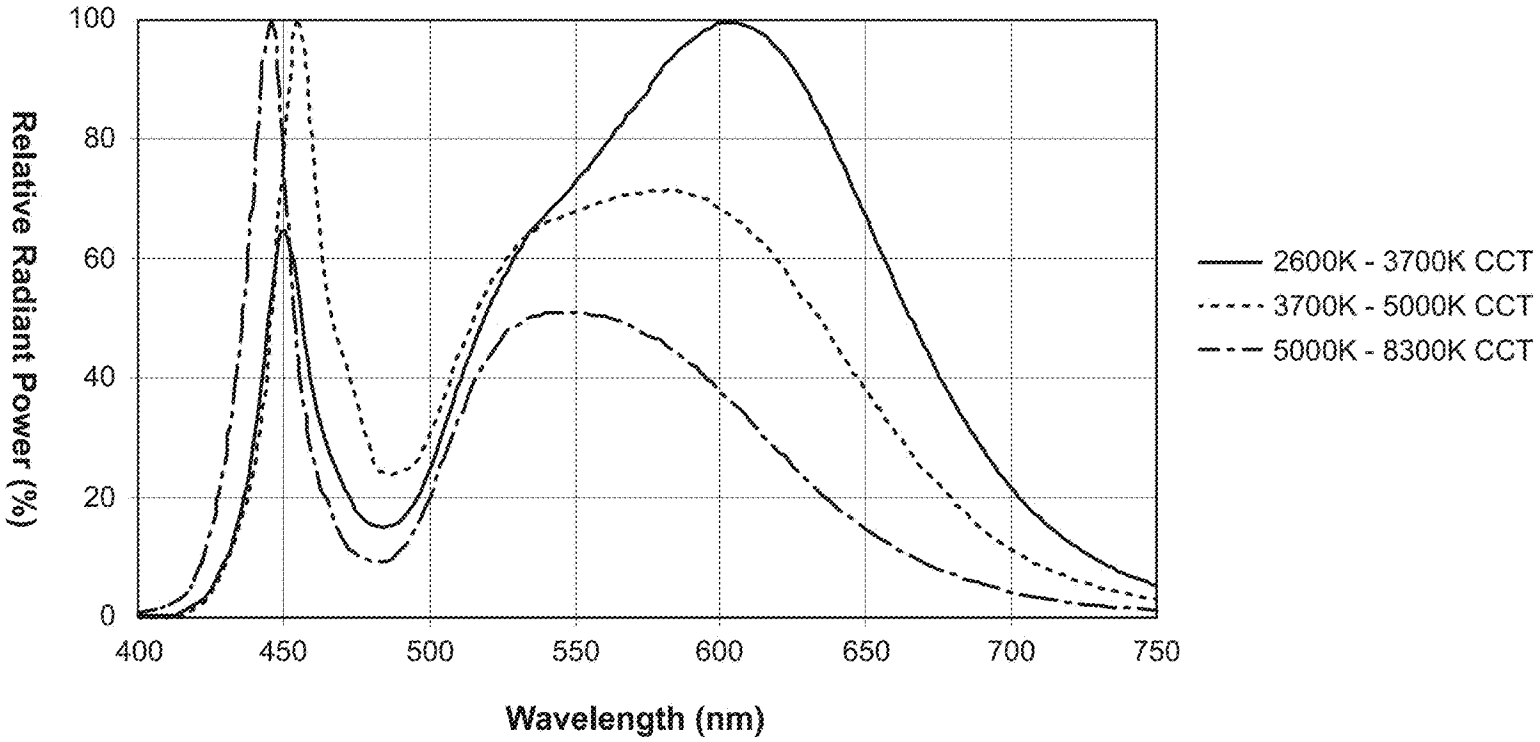

| | | | | |
|---|---|---|---|---|
| 8,491,153 | B2 | 7/2013 | Maxik | |
| 8,998,444 | B2 * | 4/2015 | Roberts | F21K 9/00 313/503 |
| 9,144,140 | B1 * | 9/2015 | Bewick | H05B 37/0218 |
| 9,788,386 | B2 * | 10/2017 | Frohnapfel | H05B 33/086 |
| 2003/0156425 | A1 * | 8/2003 | Turnbull | B60L 1/14 362/545 |
| 2004/0105264 | A1 * | 6/2004 | Spero | B60Q 1/04 362/276 |
| 2004/0239243 | A1 * | 12/2004 | Roberts | B60L 1/14 313/512 |
| 2012/0206050 | A1 * | 8/2012 | Spero | B60Q 1/04 315/152 |
| 2014/0375205 | A1 * | 12/2014 | Schmid | H05B 33/0857 315/77 |
| 2017/0348506 | A1 * | 12/2017 | Berman | A61M 21/00 |
| 2018/0056027 | A1 * | 3/2018 | Peeters | A61N 5/0618 |
| 2018/0073712 | A1 * | 3/2018 | Baaijens | F21V 9/40 |
| 2018/0163932 | A1 * | 6/2018 | Schinagl | H01L 25/0753 |

OTHER PUBLICATIONS

Spitschan, Manuel, et al., "Opponent Melanopsin and S-cone Signals in the Human Pupillary Light Response", Proceedings of the National Academy of Sciences, vol. 111, No. 43, pp. 15568-15572. Oct. 28, 2014.

Vienot, F., et al., "Domain of Metamers Exciting Intrinsically Photosensitive Retinal Ganglion Cells (ipRGCs) and Rods", Journal of the Optical Society of America. A. Optics. Image Science and Vision, vol. 29, No. 2, pp. A366-A376. Feb. 1, 2012.

Berman, Sam M., "New Discoveries in Vision Affect Lighting Practice", Lawrence Berkeley Nat'l. Lab., Berkeley, CA, USA, http://www.robertsresearchinc.com/Papers/Berman_New_Discoveries_in_Vision_Affect_Lighting_Practice.pdf, downloaded Nov. 20, 2014.

Spitchan, Manuel, et al., "Opponent Melanopsin and S-cone Signals in the Human Pupillary Light Response", Proceedings of the National Academy of Sciences, vol. 111, No. 43, pp. 15563-15572. Oct. 28, 2014.

* cited by examiner

VARYING COLOR OF LED LIGHT USING METAMERS

CROSS-REFERENCE TO RELATED APPLICATIONS

This application claims priority under 35 U.S.C. § 119 to provisional U.S. application Ser. No. 62/086,440, filed Dec. 2, 2014, hereby incorporated by reference in its entirety.

I. BACKGROUND OF INVENTION

Embodiments of the present invention generally relate to systems and methods for illumination. In particular, embodiments of the present invention relate to systems, methods, and apparatus for controlled light distribution using LEDs to provide light with desirable spectral power distributions for various applications including but not limited to sports, architectural, general area, larger area and other types of lighting.

Color, correlated color temperature (CCT), and color rendering index (CRI) are important areas of concern in the lighting industry. For example, there is a desire for providing illumination which can be of a specific color or CCT, depending on the target area and desired usage of the area. Lower CCT light, in the range of 2500 to 3500K, with a greater percentage of red wavelengths in its SPD, provides a "warmer" perceived light, which is attractive and pleasing for certain occasions. However, higher CCT light in the range above 3500K, which has more blue light in its spectral power distribution (SPD), can provide better visual acuity and a better perception of brightness, making it attractive for sports lighting or other events that require a higher level of illumination.

CRI is a useful metric for comparing lighting sources as to how closely they resemble incandescent light. This provides an objective way to compare one light source to another. However, it is understood in the industry that CRI does not completely describe quality of light for a given situation. While a higher CRI generally will provide more pleasing rendering of colors, CRI does not specify which wavelengths are more or less prominent in a specific high CRI light source. This means that a given scene which has objects which are prominent in a scene and which are of a specific color (and therefore which tend to reflect certain narrow bands of the spectrum) may, depending on wavelengths emitted by the light source, have areas or objects with relatively poor color rendering, even though the light source has an overall high CRI.

Thus there is much to be gained by improving color rendition and contrast beyond what can be described by CCT and CRI.

There is also a need to increase effectiveness of lighting, not only by increasing lumen output of a light source, but also by increasing perceived brightness, since human perception of lighting quality has much to do with the acceptability and utility of lighting. Human perception of lighting is very complex, involving color perception, brightness perception, and other factors for which scientific measurement is quite difficult.

Thus there is much to be gained by improving perception of color, brightness, contrast, or other objective or subjective factors of lighting that are influenced by the complexities of metamerism and spectral power distribution.

There is therefore room for improvement in the art.

II. SUMMARY OF INVENTION

It is therefore a principle object, feature, advantage, or aspect of the present invention to improve over the state of the art and/or address problems, issues, or deficiencies in the art.

A method according to aspects of the invention comprises creating a source lighting having a desired CCT and desired shorter wavelength ("blue") component, thereby providing the benefits of increased or decreased blue light energy on a target; wherein said light is metameric with other light on the target area that is either replaced by or is supplemented by the newly supplied light.

A further method according to aspects of the invention comprises measuring existing light, determining the SPD of the light, and selecting one or more metamers for the existing light, wherein the metamer is determined either experimentally, by reference, or mathematically to provide a desired benefit in terms of SPD, particularly with regard to increasing or decreasing shorter wavelengths.

One method of obtaining a desired metamer includes selecting three or more colors of LEDs which, when combined at specific power levels, provide a desired composite SPD. Another method is selecting one or more types, models, or bins of white LEDs having specific SPDs in a combination that provides a desired composite SPD.

In a further embodiment according to aspects of the invention, a desired metamer at a given color temperature is provided that yields an improvement in lighting. This improvement can be over existing lighting or over lighting that is selected on the basis of CCT and/or CRI alone, without significant consideration of SPD and the effect of metamers. The improvement can include improved perceived brightness or observer visual acuity. In this embodiment, a metamer is selected for a lighting source by measurement, by lookup, or by calculation based on selecting a desired spectral content in specific bands or areas.

In a further embodiment according to aspects of the invention, lighting equipment is created, modified, or added to in order to improve rendering of selected features of a target area, such as team logos or team uniforms on a sports field, without changing the color or CCT of the lighting. To create this illumination, first the spectral reflection of target is determined. Using a natural or artificial light source of known spectral distribution, light is projected onto the surface area or major objects at the field site to be lit. Using a portable spectrometer at the field site, the spectral reflection from the surface area or major objects to be lit is measured. This procedure is repeated as necessary to measure the spectral reflection from any special objects which are deemed to be especially desirable to stand out when lit. The wavelength of the predominant spectral reflectance of the target object or area is recorded and used to determine a desired partial SPD for LEDs used to light the area. A metamer is developed or selected which incorporates the desired wavelength along with other spectral values, which highlights or maximizes the major and/or preferred colors from the measured field reflections, with minimal or no variation from the preferred approximate lighting CCT.

In an embodiment according to aspects of the invention, lighting equipment is created, modified, or added to in order to provide improved contrast between a target or object and a background area. Light is provided which increases contrast by ensuring that light in a desired spectral band is sufficiently included, and that the spectral content adjacent to the desired spectral band is reduced, thereby increasing visibility of the target.

III. BRIEF DESCRIPTION OF THE DRAWINGS

From time-to-time in this description reference will be taken to the drawings which are identified by figure number and are summarized below.

FIG. 1A illustrates typical spectral power distributions of various sources of white light at different color temperatures.

Figure 1B:
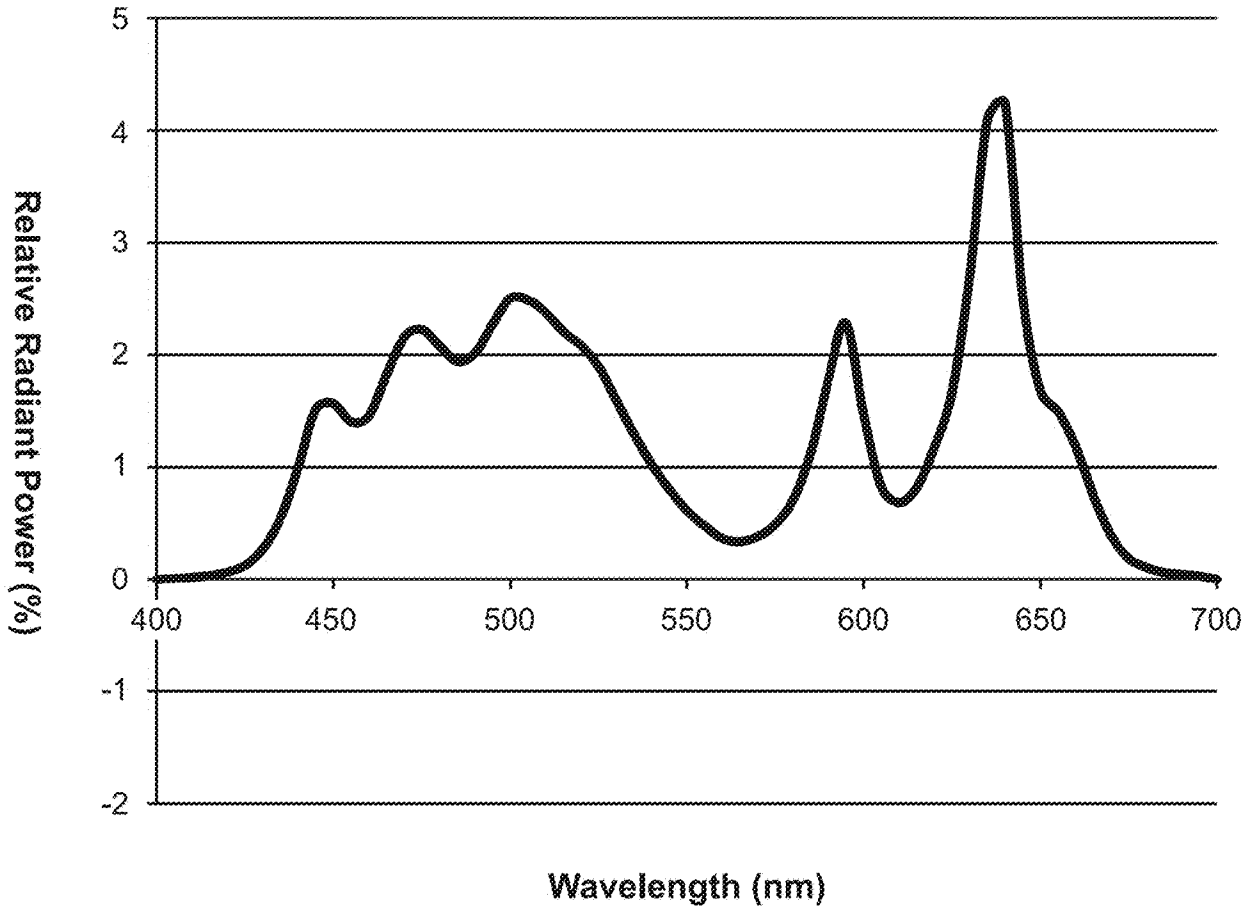
Figure 1C:
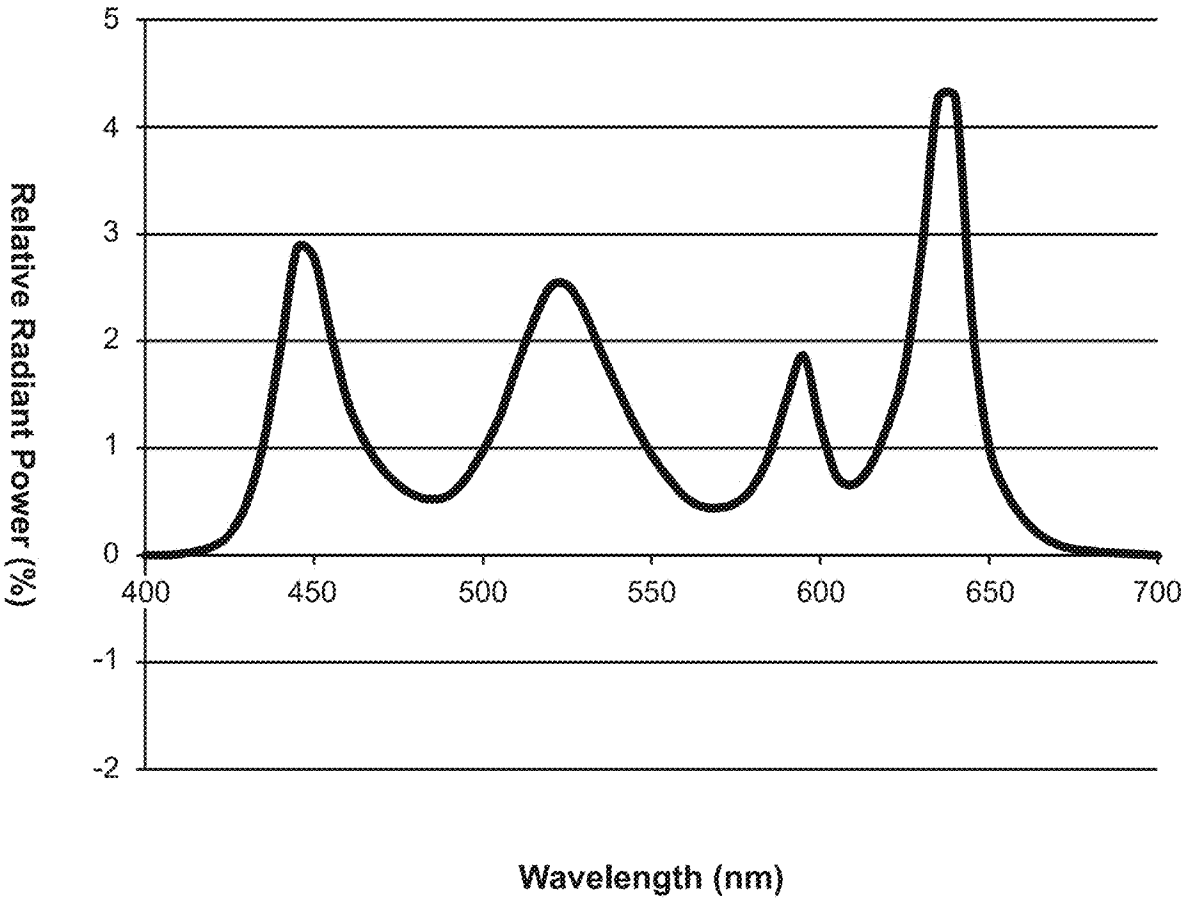

FIG. 1B-C illustrate spectral power distributions of light sources that are mutually metameric.

Figure 2A:
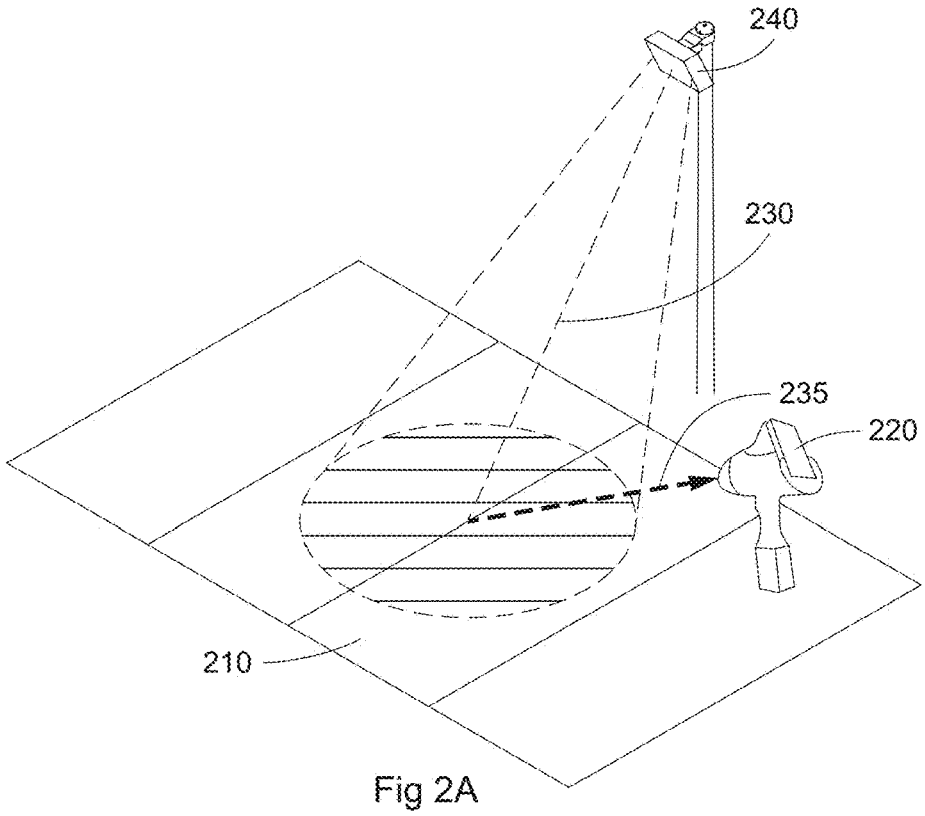
Figure 2B:
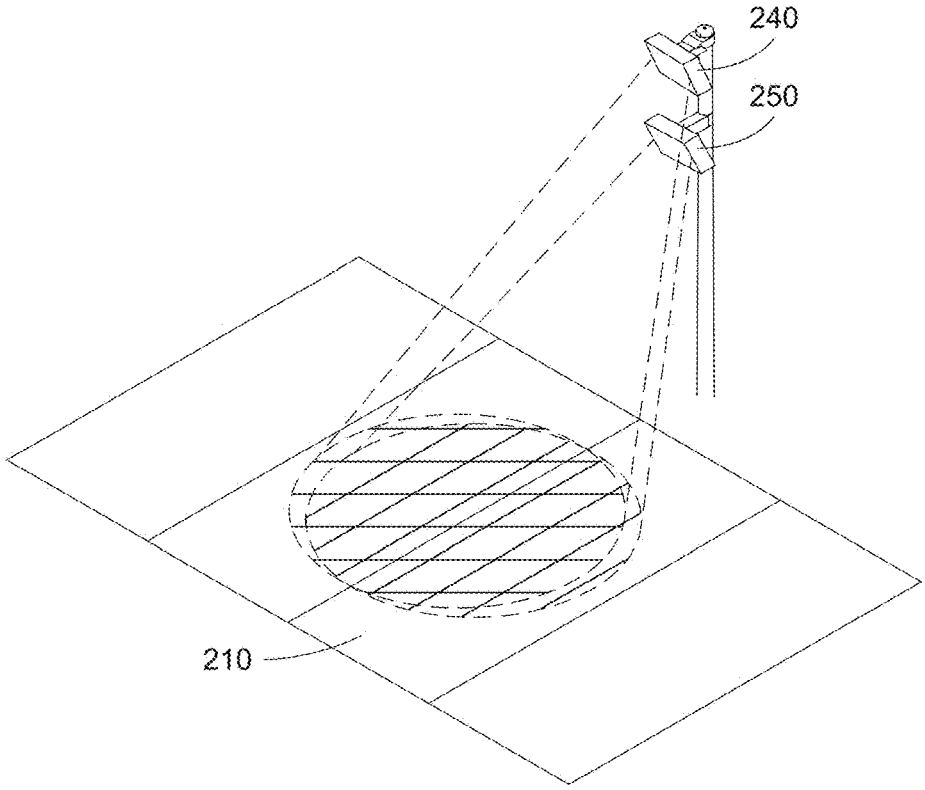

FIGS. 2A and 2B illustrate an apparatus and method according to aspects of the current invention.

FIGS. 3A-D illustrate flow charts representing methods according to aspects of the invention.

Figure 3A:
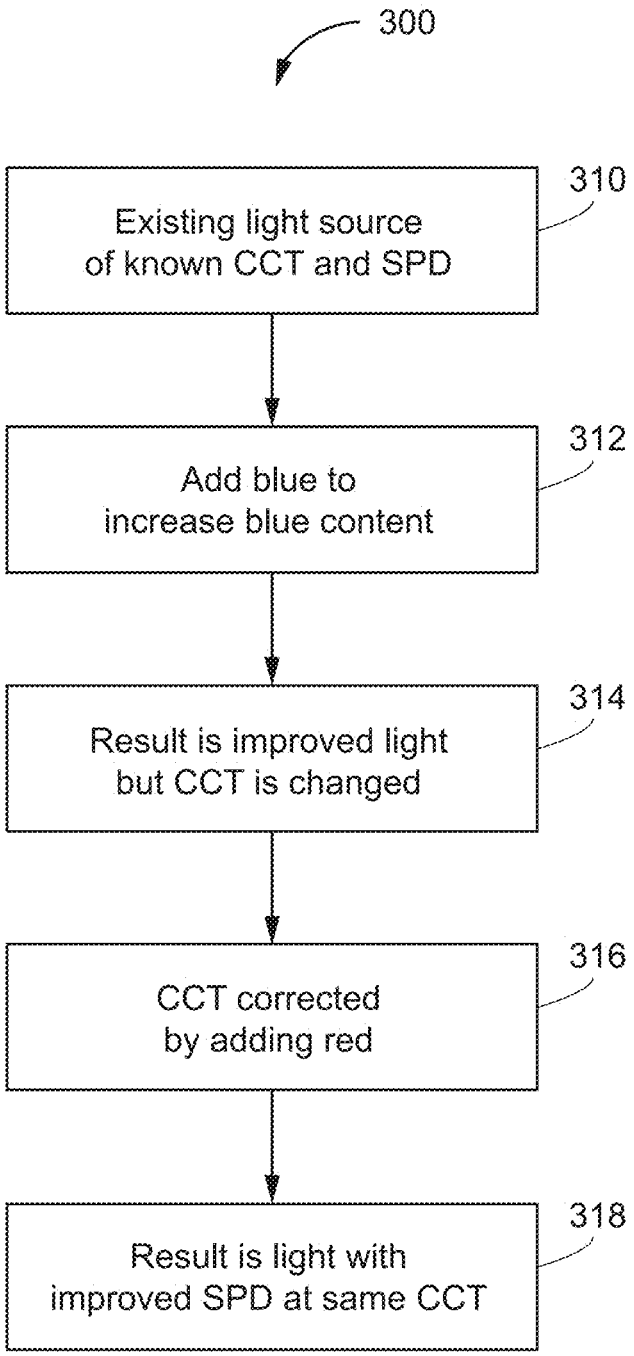
Figure 3B:
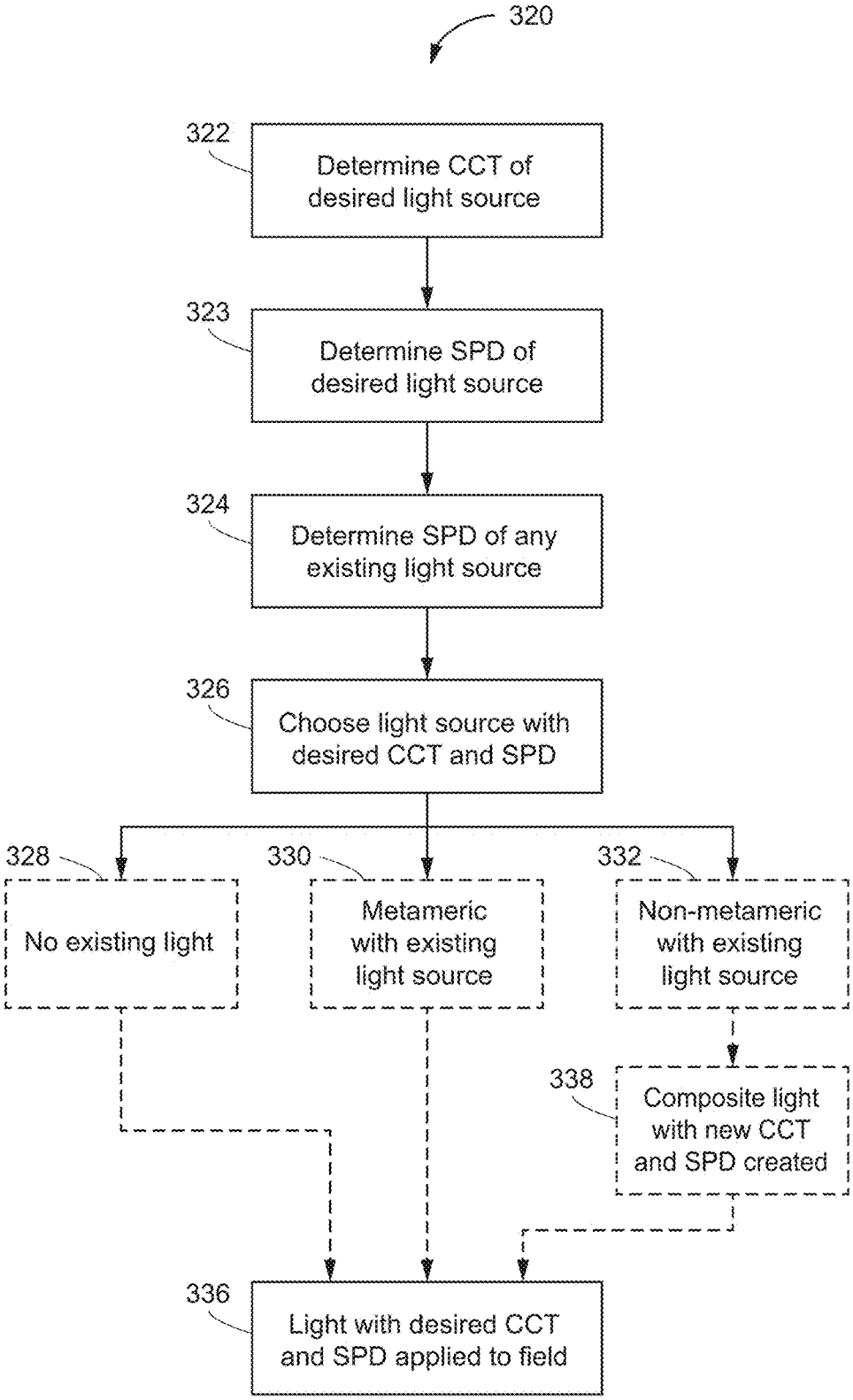
Figure 3C:
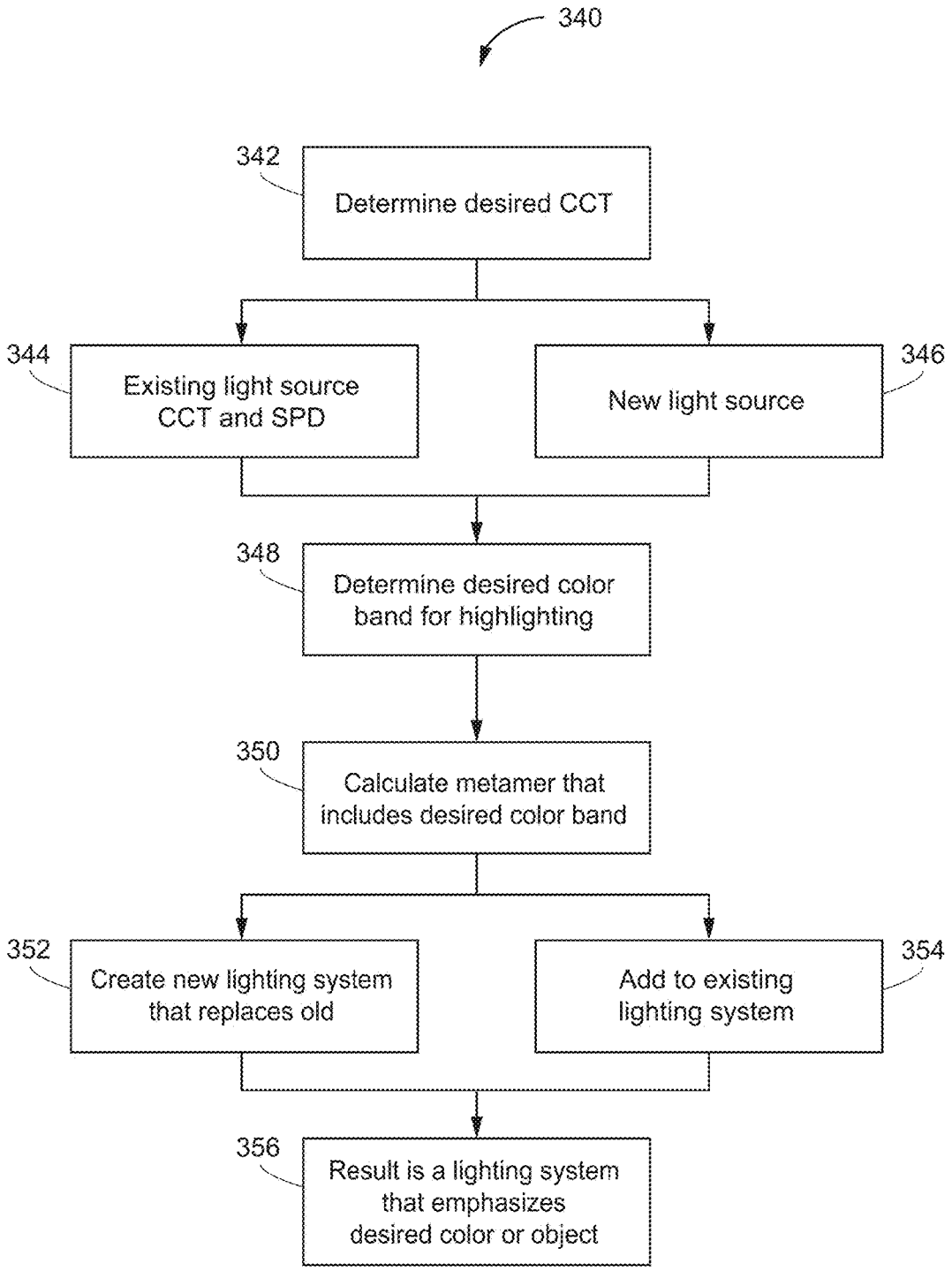
Figure 3D:
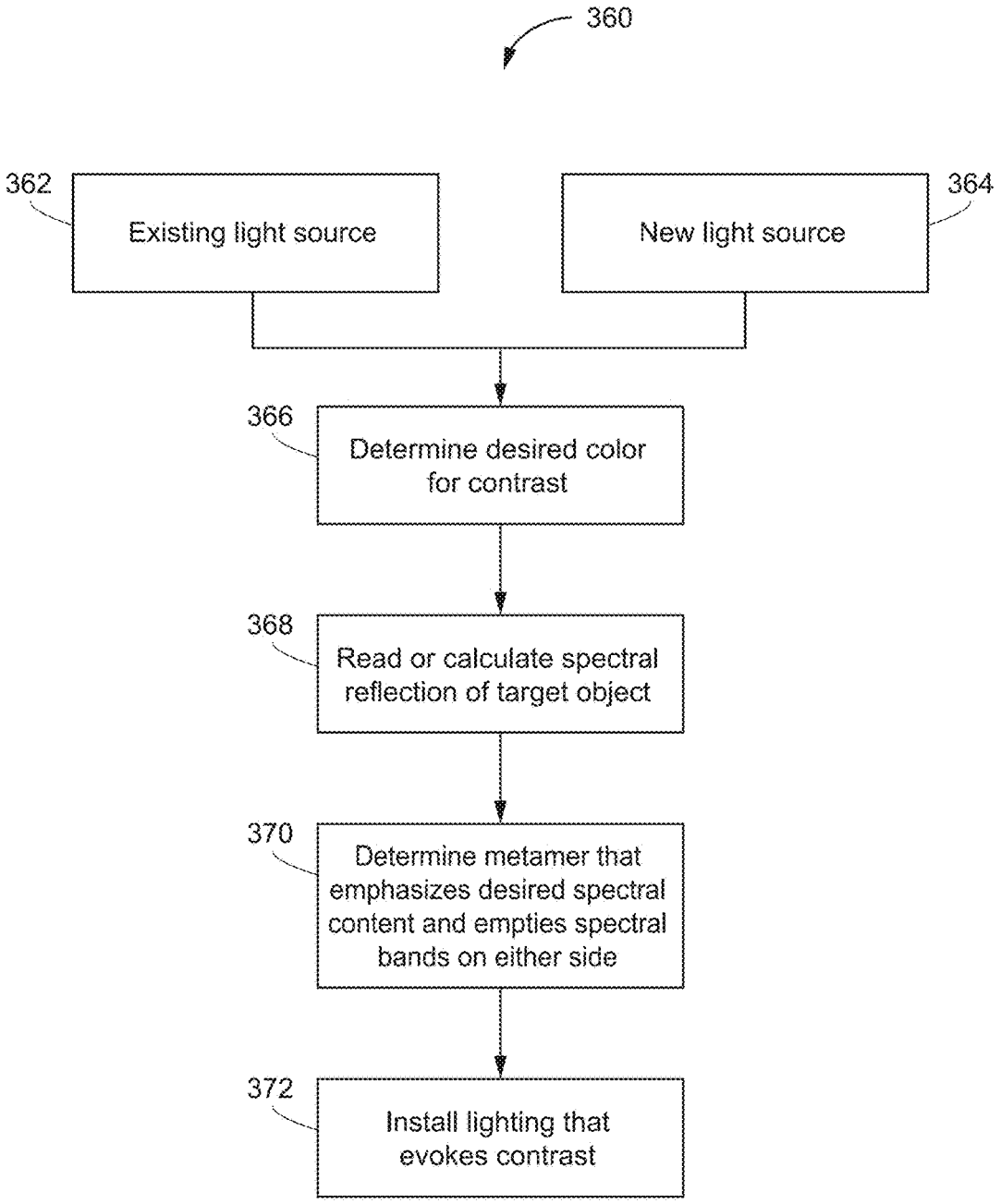
Figure 4A:
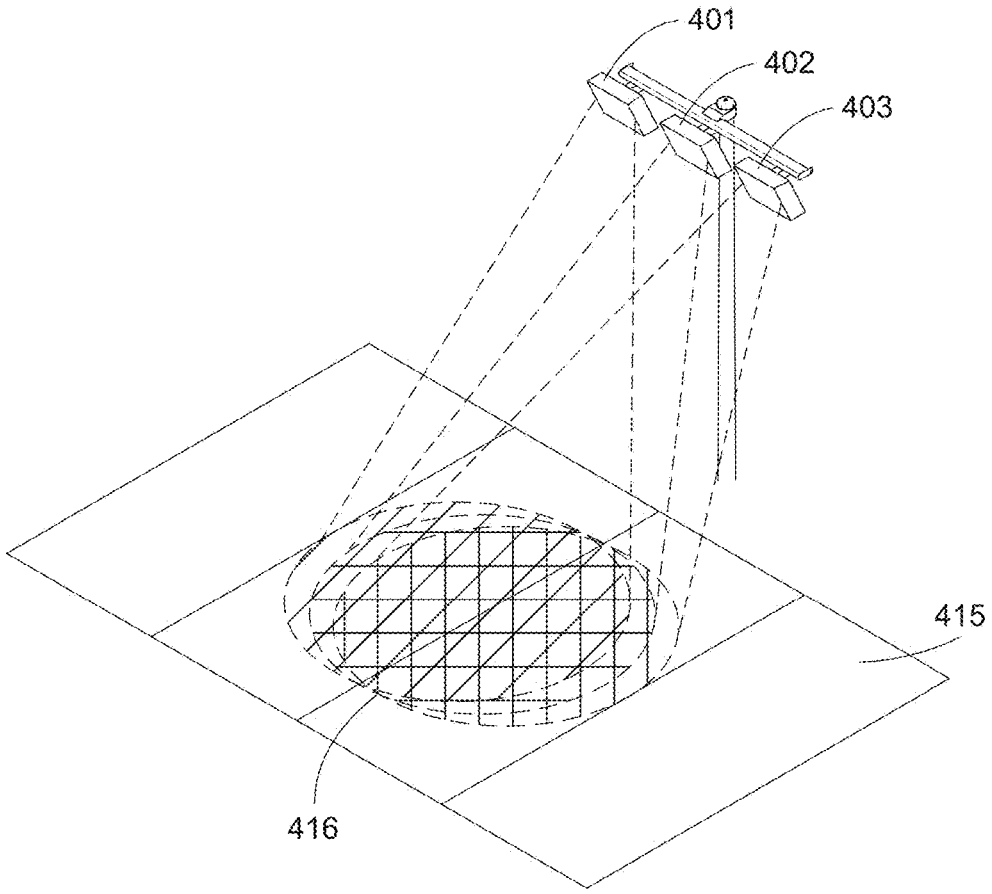
Figure 4B:
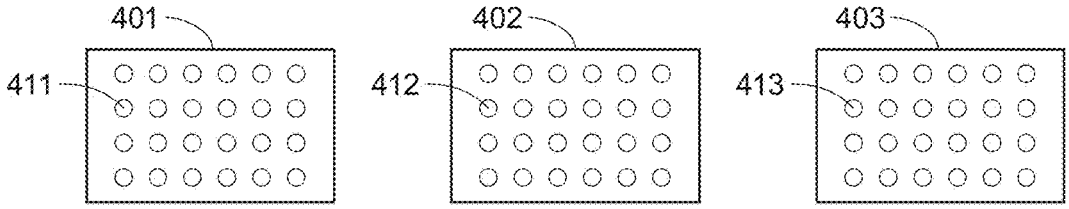
Figure 4C:
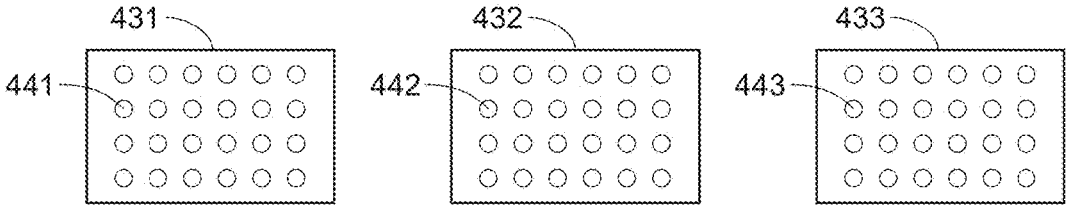

FIGS. 4A-C illustrate possible apparatus for LED light output produced according to the methods of FIGS. 3A-D.

Figure 4D:
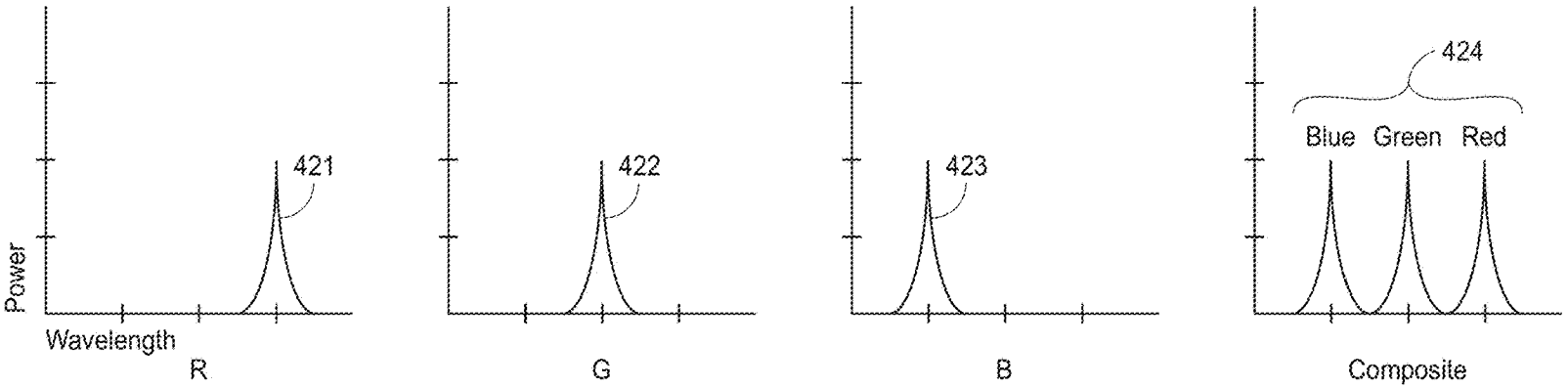
Figure 4E:
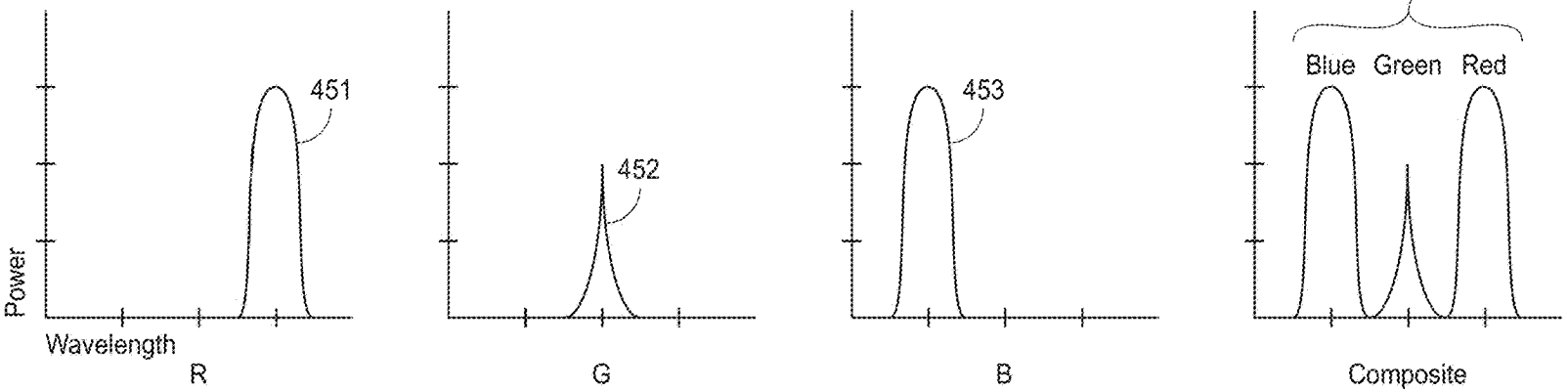

FIGS. 4D-E represent spectral power distributions of luminaires produced according to the methods of FIGS. 3A-D.

Figure 5A:
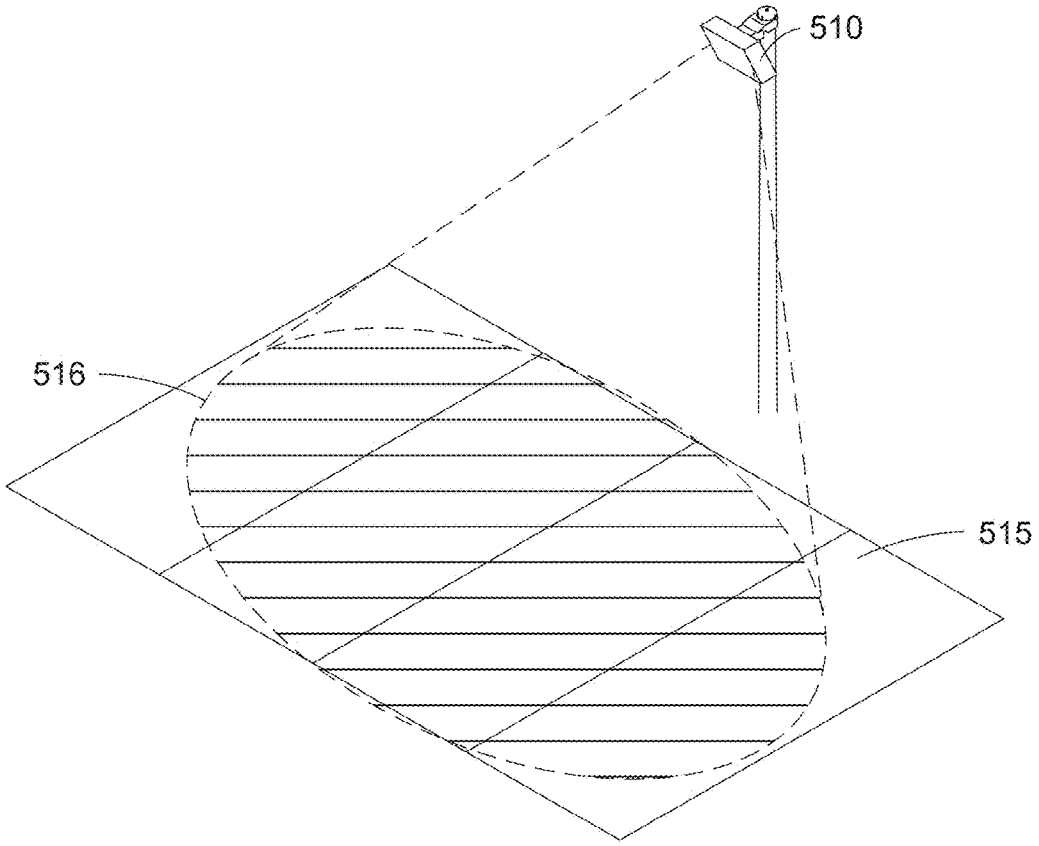
Figure 5B:
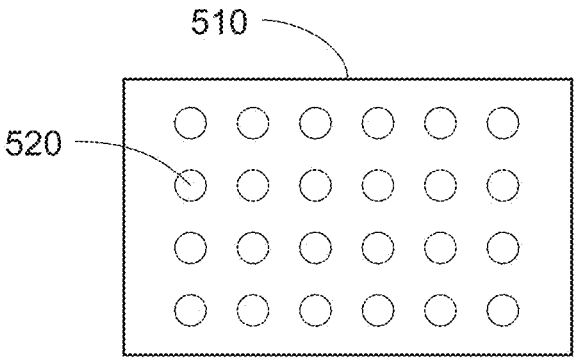
Figure 5C:
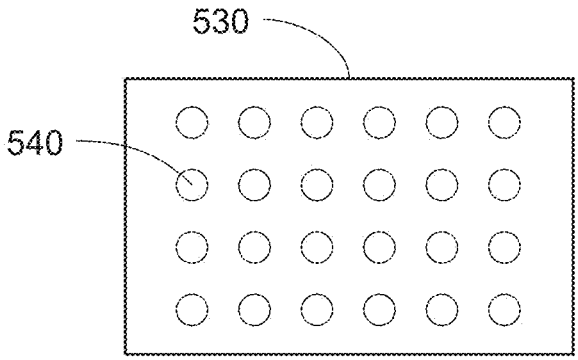

FIGS. 5A-C illustrate alternative apparatus for LED light output produced according to the methods of FIGS. 3A-D.

IV. DETAILED DESCRIPTION OF EXEMPLARY EMBODIMENTS

A. General Considerations

Several concepts are important to understand in order to appreciate the novelty, utility, and non-obviousness of the present invention. One important concept is that light at a given correlated color temperature (CCT) has an SPD that can be measured. FIG. 1A illustrates three different sources of white light that have similar but non-identical SPDs and that represent three different CCTs. It is important to note that the higher the CCT, the more pronounced will be the short wavelength component, and the lower the CCT, the more pronounced will be the long wavelength component.

Another important concept is that human color vision is understood to rely on color sensors called cone cells (or cones) to perceive color. The human eye is understood to have only three types of cone cells, which means that all colors may be described in terms of human vision by three sensory quantities called the tri-stimulus values. This means that to the human visual system, lighting sources having differing SPDs may appear identical and are perceived as having the same color or CCT. These colors that match by perception, but not by SPD, are called metamers. FIGS. 1B and 1C represent the SPD of two light sources which are metameric to each other. Note that FIG. 1C shows a sharp peak at 450 nm and a pronounced trough just below 500 nm, in comparison with FIG. 1B which shows much lower power at 450 nm. Since the spectral power distribution of a light source describes the proportion of total light emitted, transmitted, or reflected by a color sample at every visible wavelength, it precisely defines the light from any physical stimulus. Metamerism occurs because each type of cone responds to the cumulative energy from a broad range of wavelengths that are associated with the colors red, green, and blue, so that different combinations of light across all wavelengths (i.e. different SPDs) can produce an equivalent receptor response and the same tri-stimulus values or color.

Another important concern is the response of the eye to visual stimulus in non-intuitive ways. Although it is intuitively thought that the eye responds simply to overall brightness of a scene, recent research suggests that the mechanism for visual response, particularly pupillary constriction or dilation, is much more complex and less well-understood than previously thought. Thus many principles of lighting design may need to be reevaluated in order to provide an improved lighting product. Spitschan, et al., Horiguchi, et al., F. Vienot, and Berman, S., among others have written about pupillary response to particular spectral components. According to Spitschan et al.:

> "Here we study how melanopsin and the three classes of cones contribute to the human pupillary light response (PLR). Despite the intuition that pupil size should be responsive to the overall intensity of the incident light, our results reveal that a spectrally opponent system involving melanopsin contributes to pupil control at photopic light levels. The nature of this response reflects, qualitatively, the spectral opponency seen in ipRGCs [intrinsically photosensitive retinal ganglion cells]: Signals from melanopsin combine additively with those from L [long wave, i.e. "red"] and M [medium wave, i.e. "green"] cones and are opposed by signals from S [short wave, i.e. "blue"] cones." (From Spitschan, et al., *Opponent melanopsin and S-cone signals in the human pupillary light response* [comments added] at http://www.pnas.org/content/111/43/15568.full downloaded Nov. 14, 2014, which is incorporated by reference herein.)

See also, Spitscahn M, Jain S, Brainard D. H. Aguiree G K., Opponent melanopsin and S-cone signals in the human pupillary light response *Proceedings of the National Academy of Sciences of the USA* (*PNAS*) (2014) 111 (43) 15568-15572, incorporated by reference herein.

Practically, this means that S cones and other light receptors in the human eye contribute to pupillary response (dilation or contraction) separately from the response of L and M cones in a manner not previously understood, and in a way which affects both brightness perception and visual acuity.

Similarly, F. Vienot writes:

> "Any stimulus can be described as composed of two components—a fundamental color stimulus that controls the three cone responses and a metameric black that has no effect on cones but can drive photoreceptors other than cones [e.g., rods and melanopsin expressing retinal ganglion cells (ipRGCs)]. The Cohen and Kappauf [Am. J. Psychol. 95, 537 (1982)] method is extended to calculate the black metamer basis for a limited set of band spectra. Using seven colored LEDs, the method is exploited to produce real metamer illuminations that stimulate in parallel melanopsin expressing ipRGCs and rods, at most or at least. We have verified that the pupil diameter increases when the ipRGC and rod excitation is at a minimum. For 14 observers, the average relative increase is 12%." (From Vienot, F., abstract of *Domain of metamers exciting intrinsically photosensitive retinal ganglion cells* (*ipRGCs*) *and rods* [comments original] at http://www.ncbi.nlm.nih.gov/pubmed/22330402, downloaded Nov. 14, 2014, incorporated by reference herein.)

See also, Viénot F, Brettel H, Dang T V, Le Rohellec, J, *Domain of metamers exciting intrinsically photosensitive retinal ganglion cells* (*ipRGCs*) *and rods, J Opt Soc Am A Opt Image Sci Vis.* 2012 Feb. 1;29(2):A366-76, incorporated by reference herein.

This has many implications for visual science. For lighting design, it again implies that visual stimulation leading to pupillary dilation (which tends to decrease visual acuity) or to pupillary constriction (which tends to increase visual acuity) is a much more complex process than previously thought, and that the concept of metamerism, rather than just being a useful way to reproduce colors with available resources, is rather, quite important for providing lighting design that improves upon previous designs in an unexpected and commercially valuable way.

Horiguchi, et al. describe Vienot's work:

> Vienot et al . . . constructed a display apparatus with seven primaries, enabling them to generate cone-silent stimuli that modulate the rhodopsin and melanopsin pigments in human subjects. Basing their calibrations on the standard color observer from Stockman . . . , and using relatively low light levels, they report significant pupil responses in some individuals but not in others. This observation agrees with our results in that corrections for the individual photopigment characteristics of each observer and for specific light levels are probably required to achieve isolation. They make the interesting observation that two lights of equal luminance may produce different pupil apertures and thus different retinal illuminance. This finding may be significant for applications in lighting. (Horiguchi, et al., *Behavior and melanopsin in a patient*. http://www.ncbi.nlm.nih.gov/pmc/articles/PMC3549098/, downloaded Nov. 14, 2014, incorporated by reference herein.)

See also, Horiguchi H. Winawer J. Dougherty R. F. Wandell B. A. (2013). Human trichromacy revisited. *Proceedings of the National Academy of Sciences, USA,* 110 (3), E260-E269, incorporated by reference herein.

Horiguchi's observation that "two lights of equal luminance may produce different pupil apertures and thus different retinal illuminance" moves the lighting industry in a new direction which has not previously been understood, and shows that lighting which takes advantage of the ability to vary SPDs of lighting sources could produce benefits for actual or perceived brightness of a lighting source. Therefore there is much room for improvement in lighting that controls not only color or CCT, but also considers effects of stimulation of human light receptors relative the SPD, with the expectation that certain SPDs which are metamers (i.e. which have the same color or CCT) will lead to significantly different responses, either in terms of perceived brightness, or in terms of greater visual acuity due to a reduction in pupillary dilation.

S. Berman also writes:

> The discovery of a new non-central photoreceptor affirms the need for a more accurate accounting of how light affects the visual system under the full field viewing conditions encountered in most lighting practice. Incorporating the related new knowledge will provide that practice with a valuable upgrade thereby allowing the attainment of both a more visually efficient and energy efficient lighting economy.
>
> (Berman, S., *New Discoveries in Vision Affect Lighting Practice*. http://www.robertsresearchinc.com/Papers/Berman_New_Discoveries_in_Vision_Affect_Lighting_Practice.pdf, downloaded Nov. 20, 2014, incorporated by reference herein.)

See also, Berman, S. New Discoveries in Vision Affect Lighting Practice. 8 pgs. [Online] (Undated) [retrieved on Nov. 19, 2015]. Retrieved from the Internet: <URL:http://wwww.patmullins.com/data/gilbermannewdiscoveries.pdf, Accessed online on Nov. 19, 2015> and at: <URL:http://rvlti.com/documents/techpapers/AN003_How%20Light%20Meters%20Can%20Fool%20Us_v01.pdf>, and incorporated by reference herein.

B. Simplified Embodiment

A conceptual embodiment according to aspects of the invention is illustrated in flow chart 300, FIG. 3A. First, step 310, an existing light source having a known CCT and SPD is considered. Second, step 312, additional blue lighting is added to the light source, which provides desired benefits. The result, step 314, is improved light with additional blue, but with a changed CCT. Step 316, CCT of the light source is corrected by adding additional red light. The result, 318, is light with the desired additional blue spectral component, but with the original desired CCT.

A further embodiment according to aspects of the invention for an apparatus, method or system of lighting is illustrated in flow chart 320, FIG. 3B. It comprises choosing, step 322, a desired CCT for a lighting source. Next, an SPD is selected, step 323. This could be specifically for blue content, with other wavelengths selected only for total SPD, or it could be for other colors, or for a specific combination of tri-stimulus values. If existing light will be used along with the new light source, the CCT and SPD of the existing light source will be determined, step 324. Next, a light source, such as an LED or combination of LEDs with the desired CCT and SPD is selected, step 326. The result, if there is no existing light 328, will be a new lighting source 336 with the desired CCT and SPD applied to the target area. In the case of an existing light source that is not removed, the new light source may if desired be metameric 330 with the existing light source, resulting in a light 336 that has the same CCT and an SPD that contains the original spectrum as well as the new components from the new light source, which could either be blended with the entire installation, or could be directed to a specific area to provide additional spectral coverage at that location. The new light source may also be non-metameric with the existing light source. In this case the new light source and the existing light source will be blended to create a composite light 338 having the desired new CCT and SPD, and again step 336, a lighting source with the desired CCT and SPD is applied to the target area.

A further embodiment according to aspects of the invention for an apparatus, method or system of lighting is illustrated in flow chart 340, FIG. 3C. It comprises selecting a lighting source having a desired CCT step, in order to create a visual highlight or emphasis. First, step 342, is to determine a desired CCT for a light source. If there is an existing light source, its CCT will be determined, step 344. Or if there is no existing light source, the new CCT will be selected for its desired effect by itself, Step 346. Then a target color having a discernible and desirable response to a specific spectral output is selected, step 348. This could be an object such as a team logo on a sports field. Or it could be team uniforms, or other features or decorations in the target area. Next a metamer is calculated that includes a spectral content that highlights the desired object, Step 350. Then either a new lighting system is created, Step 352, or luminaires are installed, Step 354, to supplement the existing lighting system and aimed to highlight the desired target or to supplement the entire area. The result, Step 356, is a lighting system that emphasizes one or more areas, objects, or targets within the target area.

A further embodiment according to aspects of the invention for an apparatus, method or system of lighting for determining a desired color or CCT and SPD for a lighting system in order to provide increased contrast for objects or areas in a target area is illustrated in flow chart 360, FIG. 3D. First, either an existing lighting system, step 362, or a new lighting system, step 364, is selected. Next, a desired color is selected for contrastive viewing, step 366. This color could be e.g. the wavelength strongly reflected from a yellow softball. This may be determined by reading spectral reflectance from the object, step 368. Next, a metamer is calculated or determined 370 by lookup or other means that includes the spectral content which is strongly reflected from the object, and which also has little to no spectral content in the bands on either side of the color to be highlighted. Finally, step 372, a lighting system is installed which creates the desired contrast.

C. Further Embodiment

FIG. 2A-B illustrates an embodiment according to aspects of the invention, wherein a lighting source 250, FIG. 2B is chosen that has a desired CCT and that has a desired amount of shorter wavelength ("blue") light energy, in order to provide benefits of increased blue light energy on a target. The light source could be newly installed, could be used to supplement an existing light source 240, FIG. 2A, or could replace an existing light source. For example, a CCT of 4200K might be provided by an existing lighting system, or 4200K might be a desired CCT for a new lighting installation.

For addition to or replacement of an existing light source at the same CCT, the new light source will, by definition, be metameric with the existing light source. In other words, as spectrally distinct light sources having differing SPDs, they have the same photometric magnitude and therefore appear indistinguishable. So in simplified terms, if more blue light is added to a light source, more red light will also be added to maintain the same color temperature. And though visual perception of the color will be the same, nonetheless, the physiological and neural responses in human visual systems to different metamers can differ significantly, particularly with reference to the relative power and specific wavelength of the blue component of the total light. Animal life can also be affected by the amount of blue light in artificial lighting, apart from consideration of metameric effects on humans.

The effects and potential benefits or detriments of increased blue lighting are the subjects of intense discussion in the lighting industry, but it is agreed that the amount of blue lighting in the SPD of a light source is a significant factor in how the human visual system processes the lighting in a given scene. Effects of increased blue lighting can include better vision in low light settings, greater visual acuity for sports play, better lighting efficiency, and an increased Scotopic/Photopic (S/P) ratio. S/P ratio compares the measured scotopic lumens to the measured photopic lumens for a given lamp. The higher the S/P ratio, the better the light source will perform for illumination at low (scotopic and mesopic) levels, on a comparison of amount of useful light for a given amount of energy expended. And according to Horiguchi, et al., referenced above, pupillary constriction by stimulation of retinal ganglion cells (ipRGCs) is a benefit of increased blue light such that the result in lay terms would be increased visual acuity under some circumstances.

Subjectively, human observers may find some metamers to appear brighter for a given amount of luminous energy, with the result that either the scene appears brighter and therefore more desirable, or a lower amount of light energy may be used for scene illumination to provide the same perceived brightness, which can in turn allow for lower costs for construction and operation of lighting, and potentially increased longevity of lighting components.

So for an existing lighting system, the SPD of the light will be analyzed using analyzer 220, FIG. 2A (it would receive reflection(s) 235 from the target, here a sports field 210, which is artificially illuminated by light 230). This can be done with available tools, such as the commercially-available ASD Inc. Model FieldSpec HandHeld 2 Pro available from PANalytical company d/b/a ASD Inc., 2555 55th Street, Suite 100, Boulder, Colo. 80301. Then a metamer having a differing SPD, which could have a more pronounced or broader blue peak, could be selected. The method for doing this is well-known in the industry. An example of this method is presented in Boxler, L. *Color Temperature and Sports Vision* which is included as Appendix E in provisional U.S. application Ser. No. 62/086,440, which is incorporated by reference herein. The result would be a metamer of the original lighting, which would appear to the human observer to have the same color quality (corresponding to the same CCT), with the benefit of a change in the amount or spectral distribution of shorter wavelength blue light in the lighting.

It should be noted that obtaining different metamers of light may be physically enabled in a number of ways. One scheme for providing a desired CCT of light which by itself does not address possible metameric combinations is using separate LEDs to provide three or more stimulus values, using an RGB or other scheme. This is illustrated in FIG. 4A-E. Each LED is powered at a desired level to provide the desired CCT, with the result that the SPD of the lighting system will be the sum of the SPDs of the individual LEDs. This scheme is well known for providing both colored lighting and for providing white lighting of varying CCT by varying the individual RGB contributions. However, to change the blue spectral component without changing the CCT, different red, green and blue LEDs having different SPDs would have to be used.

Another well-known method of using LEDs to provide white light of a given color temperature is simply selecting available white LEDs which are already classified by CCT. This has been done ordinarily without regard to the specific blue spectral contribution, since the CCT of the LED output has so far been the main concern for lighting designers. Thus the light output from LED installations may have a blue content that randomly might be highly desirable or may be much less than optimal. In these cases, considering the weighting of the spectral components of the total SPD of available outputs will be necessary to provide the desired blue component while also providing the desired CCT. So a manufacturer or supplier of LED lighting systems could benefit greatly by analyzing available LEDs and selecting not only for CCT, but for the desired metameric SPD. Such embodiments are illustrated in FIG. 3A-D and discussed further below.

The method can also be used to reduce the energy requirement as the additional light colors will be highly reflected from the surface or objects and will allow for the given photopic light level to be reduced while still achieving the same apparent brightness perception. This method is further described below.

D. Further Embodiment

FIG. 4A-C illustrates an embodiment according to aspects of the invention. LED light sources 401, 402, and 403, FIG. 4A-B, represent typical luminaires used at a sports field. These luminaires contain red, green, and blue LEDs 411, 412, and 413 respectively, and are used to provide white light 416 of a specific CCT and SPD on field 415, by blending their respective outputs. The SPD of each light is shown in FIG. 4D, where 421, 422, and 423 represent a simplified outputs for R, G, and B LEDs 411, 412, and 413 respectively. Reference number 424 represents the combined SPD of the blended light from the three luminaires. So in order to provide a greater blue spectral content, a set of new LEDs 443, (FIG. 4C) are substituted in a similar luminaire 433 for the set 413 of blue LEDs in luminaire 403 (FIG. 4B). The spectral output of the LEDs 443 is represented by spectral line 453, FIG. 4E, which is significantly larger in amplitude and width than 423 in FIG. 4D.

But if the additional blue is added by itself, the CCT of the blended light will be significantly changed. In order to create the same tri-stimulus values, red LEDs 441 in luminaire 431, having a SPD shown by spectral line 451, are substituted for LEDs 411, with 452 representing the same green spectral content (from LEDs 442 in fixture 432) as in SPD 422 from fixture 402. The result is a composite SPD 454 which has the increased blue content but is metameric with 424, FIG. 4D, owing to the increased red spectral content.

This can be further embodied by single luminaires containing red, green, and blue LEDs instead of separate red, green, and blue luminaires as previously described. It can further be embodied by replacing white LEDs 520, FIG. 5B, in a luminaire 510, FIG. 5A-B, that exhibit an SPD such as 424, FIG. 4D, with white LEDs 540 in a luminaire 530, FIG. 5C, that exhibit an SPD such as 454, FIG. 4E. The result is again a second luminaire emitting a light having greater blue content but that is metameric with the light from a first luminaire having less blue content. An example is a composite beam 516 on a sports field 515.

Of course these changes could be done with metamers for different colors as well as CCTs, and could be done to emphasize red or green wavelengths. Further, different or additional primary colors could be used, and different portions of the visible band could be emphasized or de-emphasized, depending on the needs of the situation.

E. Further Embodiment for Enhanced Spectral Power Distribution

In a further embodiment according to aspects of the invention, a desired metamer at a given color temperature is provided for lighting that yields an improvement in lighting, which could include improved perceived brightness or observer visual acuity. First, color or CCT is selected for a lighting source. This can be done in several ways. One way is to measure light for visual effect. Metamers are compared using controlled testing with human observers and proposed LED combinations. From given metameric light selections, the result will be a specific SPD from a specific combination of 3 or more LEDs at a known power level that testing has shown to have the desired visual effect. One such test would be having multiple subjects compare several metamers under controlled conditions and select a metamer that has the highest perceived brightness, the best visual acuity, or other desirable effect.

Another way to select a desired metamer is to use lookup methods. Prior testing or empirical studies of the effect of different SPDs or metamers could be stored for further reference. When a lighting system is being selected, the existing lighting system could be matched to its closest analogue in records. Then a metamer that has been observed to provide more desirable visual results, such as better perceived brightness or other desired effects, could be selected and a lighting system installed using appropriate LEDs.

Still another method to select a desired metamer having at least three varying visual stimulus values and having an improved value for the short wavelength value is to first choose a desired "blue" or short wavelength characteristic. Possible choices might be one of the following characteristics: (a) the shortest available wavelengths, or (b) wavelengths closest to 400 nm, or (c) wavelengths closest to another point that is believed to provide pupillary constriction. Then other stimulus values (typically medium ("green") and long ("red") wavelengths) would be selected to complement the first wavelength to create the desired CCT. The result will be a specific SPD. One way to do this with available LEDs would be to use 3 or more separate colored LEDs, or to pick from available LEDs having the desired CCT and known SPDs. Or combinations of these methods could be used, for example using white LEDs plus a number of other LEDs such as blue or blue-weighted LEDs if additional blue was needed to achieve the desired CCT and SPD. Or other colored LEDs might be used as long as the mathematical combination of the light outputs of the combined LEDs in a given fixture or set of fixtures yielded the desired CCT and SPD.

F. Further Embodiment for Enhanced Visual Effect for Colored Targets or Target Areas In an embodiment according to aspects of the invention, lighting equipment is created, modified, or added to in order to render selected features of a target area with greater clarity or depth of color.

For example, areas or objects, such as team logos or team uniforms on a sports field, are illuminated to show up more clearly or more distinctly without changing the color or color temperature of the lighting that is supplied. This is illustrated in FIG. 2A-B.

To create this illumination, first the spectral reflection of target 210, FIG. 2A is determined. Using a natural or artificial light source 240 of known spectral distribution, light is projected along an optical axis 230 onto the surface area or major objects at the field site to be lit.

Using a portable spectrometer 220 at the field site, the spectral reflection 235 from the surface area or major objects to be lit is measured.

This procedure is repeated as necessary to measure the spectral reflection from any special objects which are deemed to be especially desirable to stand out when lit.

The wavelength of the predominant spectral reflectance of the target object or area is recorded and used to determine a desired partial SPD for LEDs used to light the area. A metamer is developed or selected which incorporates the desired wavelength along with other spectral values, which highlights or maximizes the major and/or preferred colors from the measured field reflections, with minimal variation from the preferred CCT of the LED. The process of developing metamers is well known in the industry, and is described by Boxler, L. *Color Temperature and Sports Vision* in outline in Appendix E in provisional U.S. application Ser. No. 62/086,440 and incorporated by reference herein.

The resulting metameric light is added to the beam or parts of the beam to maximize the brightness perception of the area and/or preferred objects to be lit. Added light is shown here in a separate fixture 250, FIG. 2B. This light has the equivalent CCT as the original but has greater luminous power in the wavelengths that will cause the target area or object to be effectively highlighted. As a result, there is no apparent difference in the color of the lighting; however the target area appears to have much more saturated color. The result is an improved visual display of a desired target.

G. Further Embodiment for Improved Contrast Between a Target or Object and a Background Area In an embodiment according to aspects of the invention, lighting equipment is created, modified, or added to in order to provide improved contrast between a target or object and a background area.

U.S. Pat. No. 6,631,987, incorporated by reference herein, shows that greater contrast can be achieved by reducing "bridging" colors between a desired object and its surroundings. However said patent describes each player or observer using special glasses in order to provide increased contrast. This is of no benefit to anyone not wearing the special glasses, and requires active efforts for the benefits of enhanced contrast to be realized. The present embodiment counterintuitively provides light which is "pre-filtered" and which provides increased contrast without any effort or use of special devices on the part of the observer.

This embodiment could be used in the case of a specified target, for example, a sports logo that is predominantly green which is hard to distinguish from a background of artificial turf that is also green and that reflects a broad spectrum in the green range. In this case, illumination with an SPD with a specific "spike" that is reflected by the logo, but contains little or no illumination of a slightly shorter or longer wavelength on either side of the spike would be optimal. This would reduce the effect of a gradual transition from the color of the target area to its surrounding, and would tend to increase contrast and visibility.

To create this lighting effect, a light source is characterized according to SPD and CCT and used to illuminate a target or target area as previously described. The target or target area is analyzed for spectral reflectance. Spectral areas that are strongly reflected by the target are identified, and a metamer with equivalent CCT is selected that illuminates the target but reduces luminous energy in the wavelengths surrounding the target wavelengths. In this embodiment, best results will likely result from new or replacement lighting instead of supplemental lighting, since the effect requires both enhancing a specific wavelength and ensuring that other wavelengths are limited.

In addition to logos or decorations, many other objects or areas such as sports equipment and safety markings could benefit from this enhanced lighting method, system, and apparatus.

H. Options, Alternatives, and Uses

Additional uses for aspects of the invention as envisioned include but are not limited to:

1. Instead of matching CCT, select for lower CCT or other subjective results such as possibly concert or performance lighting that creates a "warmer" or more inviting visual appearance. Or match CCT, but select a metamer that provides different benefits, such as pupillary dilation rather than contraction, for a more casual or relaxed visual effect.

2. Providing more contrast and minimize reflected glare off of snow for skiing. It is thought that reducing the percentage of shorter wavelengths in illumination allows for more contrast.

3. Penetrating through and reflecting less in fog, rain or falling snow, since different wavelengths of light have different abilities to penetrate water particles in the air. This could provide possible benefits for drivers, air traffic control etc.

4. Improving the twilight and night time visibility of an airborne golf ball, tennis ball, baseball, football, etc. either by improving the spectral selection of lighting in order to highlight the ball, or by improving visual acuity by increasing blue light content.

5. Improving the light penetration into water. It is known that shorter wavelengths of the light spectrum can penetrate further than the longer wavelengths. Increasing the percentage of shorter wavelengths in illumination could allow improved visual performance for swimming pool life guards and divers. It could also improve the color of water-based decorations such as pools, streams, and waterfalls, etc.

6. Varying intensity of at least a portion of the light modified with respect to SPD by either a smooth or abrupt (i.e. flashing) transition to create special effects or greater noticeability of a desired target area or object.

What is claimed is:

1. A method for illumination of a target by changing a spectral makeup of light from a plurality of light fixtures for desired lighting effects without changing CCT comprising:

a. identifying a preferred color or a maximized brightness perception on an area or object related to the target;
b. installing a plurality of light fixtures relative the target to provide illumination of the target wherein each of the light fixtures includes a plurality of solid state light sources each of which contribute to a portion of the illumination of the target;
c. changing the spectral makeup of the solid state light sources to produce increased light of a wavelength that increases human perception of the identified color or maximum brightness perception; and
d. further changing the spectral makeup of the solid state light sources to produce increased light of a wavelength that does not increase human perception of the identified color or maximum brightness perception but preserves CCT;
e. such that desired lighting effects are provided without changing CCT of the illumination.

2. The method of claim 1 wherein the changing the spectral makeup to increase human perception is of a first subset of the plurality of solid state light sources, and wherein the changing the spectral makeup to preserve CCT is of a second subset of the plurality of solid state light sources, such that at least some solid state light sources within a light fixture have different color or CCT relative to other solid state light sources within said light fixture.

3. The method of claim 1 further comprising operating the light sources in one of:

a. steady-state mode;
b. flashing mode; or
c. highlighting one or more colors from the solid state sources.

4. The method of claim 1 wherein the spectral makeup is changed in response to an environmental factor selected from:

a. snow;
b. fog;
c. twilight; and
d. water.

5. The method of claim 1 wherein the changing spectral makeup to increase human perception comprises:

a. increasing power in a first spectral band within the spectrum of the lighting; and b. decreasing power in side bands to the first spectral band.

6. A method of illuminating a target comprising:

a. selecting multiple solid state light sources each of which has a different spectral power distribution;

b. operating the multiple solid state light sources at different power levels to provide lighting comprising generally white light at a given CCT that emphasizes one or more desired individual colors within a spectrum of light; and c. changing the different power levels while maintaining said CCT to produce a dimmed illumination of the target without changing the CCT of the illumination.

7. The method of claim 6 wherein the illumination is provided with a desired CRI over spectral range of white light.

8. A method for illuminating a target area or object within the target area by supplementing existing lighting with lighting of the same CCT but which produces a desirable lighting effect comprising:

a. providing generally white illumination of a defined CCT for the target area from an existing lighting system;

b. measuring a spectral power distribution of the existing lighting system;

c. designing one or more lighting fixtures said one or more lighting fixtures having a spectral power distribution different from the spectral power distribution of the existing lighting system, and wherein the step of designing comprises:

i. increasing the amount of light of a first color of the designed lighting fixture wherein said light of a first color produces a desirable lighting effect; and ii. adding a complimentary color to the light of the first color of the designed lighting fixtures; and d. adding the designed lighting fixtures to the existing lighting system so to maintain CCT of the illumination while providing a desirable lighting effect.

9. The method of claim 8 further comprising using blue light as the first color and using red light as the complimentary color.

10. The method of claim 8 further comprising:

a. reducing power and measured brightness of the illumination after adding the designed lighting fixture to the existing lighting system.

11. A method of illumination comprising:

a. determining spectral reflection of a target area;

b. identifying one or more LEDs to light the area, said one or more LEDs having a defined spectral output and CCT said spectral output having a spike at a wavelength which produces a desirable lighting effect;

c. developing a metamer which has the same CCT as the one or more identified LEDs but has a lower relative radiant power at a wavelength below the spike and at a wavelength above the spike;

d. adding additional LEDs produced with the developed metamer to the one or more identified LEDs; and e. illuminating the target area with both the one or more identified LEDs and the additional LEDs produced with the developed metamer;

f. so to increase contrast at the target area without changing CCT of the illumination.

12. The method of claim 11 wherein the additional LEDs are either:

a. combinations of additional LEDs having three or more stimulus values using an RGB or other multi-stimulus scheme, which provide as a combination a specific SPD having outputs that are blended with the output of the one or more LEDs; or b. white output LEDs with different SPDs.

13. A system for illuminating an area comprising:

a. a plurality of light fixtures on elevating structures positioned around the area;

b. a plurality of solid state light sources in each light fixture;

c. a first subset of the plurality of solid state light sources outputting light to the area at a first CCT; and d. a second subset of the plurality of solid state light sources outputting light which is metameric to the light from the first subset.

14. The system of claim 13 wherein the illuminating and the area relates to:

a. sports lighting;

b. architectural lighting;

c. general lighting; or d. area lightings.

15. The system of claim 13 wherein the first CCT comprises a first SPD and the metameric light comprises a second SPD at or near the first CCT.

16. The system of claim 15 wherein the first CCT comprises white light.

17. The system of claim 16 wherein the second set of solid state light sources comprise:

a. LEDs of different colors; or b. LEDs of different SPDs.

* * * * *